US007954921B2

(12) United States Patent
Ben-Zur et al.

(10) Patent No.: US 7,954,921 B2
(45) Date of Patent: Jun. 7, 2011

(54) DIGITAL PRINTING APPARATUS

(75) Inventors: Ofer Ben-Zur, RaAnana (IL); Yossi Pearl, Tel-Aviv (IL)

(73) Assignee: Kornit Digital Technologies Ltd., Rosh HaAyin (IL)

( * ) Notice: Subject to any disclaimer, the term of this patent is extended or adjusted under 35 U.S.C. 154(b) by 1026 days.

(21) Appl. No.: 10/589,234

(22) PCT Filed: Feb. 10, 2005

(86) PCT No.: PCT/IL2005/000166
§ 371 (c)(1),
(2), (4) Date: May 14, 2007

(87) PCT Pub. No.: WO2005/076730
PCT Pub. Date: Aug. 25, 2005

(65) Prior Publication Data

US 2008/0012884 A1 Jan. 17, 2008

(30) Foreign Application Priority Data

May 30, 2004 (IL) ..... 162231

(51) Int. Cl.
*B41J 2/015* (2006.01)
*B41J 2/165* (2006.01)

(52) U.S. Cl. ..... 347/21; 347/20; 347/22; 347/29

(58) Field of Classification Search ..... 347/20
See application file for complete search history.

(56) References Cited

U.S. PATENT DOCUMENTS

| | | | |
|---|---|---|---|
| 3,968,498 | A | 7/1976 | Uchiyama |
| 4,021,591 | A | 5/1977 | De Vries et al. |
| 4,296,421 | A | 10/1981 | Hara et al. |
| 4,312,007 | A | 1/1982 | Winfield |
| 4,380,770 | A | 4/1983 | Maruyama |
| 4,630,076 | A | 12/1986 | Yoshimura |
| 4,702,742 | A | 10/1987 | Iwata et al. |
| 5,349,021 | A | 9/1994 | Rooney et al. |

(Continued)

FOREIGN PATENT DOCUMENTS

| | | |
|---|---|---|
| EP | 1281533 | 2/2003 |

(Continued)

OTHER PUBLICATIONS

International Search Report Dated Jan. 4, 2006 From the International Searching Authority Re.: Application No. PCT/IL05/00559.

(Continued)

*Primary Examiner* — Matthew Luu
*Assistant Examiner* — Kendrick X Liu

(57) ABSTRACT

A digital printing machine includes a rigid frame, a first linear motion X axis stage mounted on the frame, a printing table assembly movable on each linear X axis stage, a linear motion Y axis stage mounted on the frame perpendicular to the linear X axis stages, above the printing table assemblies, and an array of inkjet nozzles mounted on the linear Y axis stage for linear motion perpendicular to the X axis stage, also a second linear motion X axis stage mounted on the frame parallel to the first axis stage and arranged for operation independently of the first axis stage, and/or a curing unit located above the printing table assembly and/or a pre-printing wetting assembly, for printing over garments, by applying wetting composition on the printed material, prior to printing.

7 Claims, 15 Drawing Sheets

U.S. PATENT DOCUMENTS

| | | | | |
|---|---|---|---|---|
| 5,501,902 | A | | 3/1996 | Kronzer |
| 5,510,415 | A | | 4/1996 | Zahrobsky et al. |
| 5,534,904 | A | | 7/1996 | Sheinman |
| 5,582,104 | A | | 12/1996 | Best et al. |
| 5,594,044 | A | | 1/1997 | Yang |
| 5,631,684 | A | | 5/1997 | Takaide et al. |
| 5,645,888 | A | | 7/1997 | Titterington et al. |
| 5,757,407 | A | | 5/1998 | Rezanka |
| 5,798,179 | A | | 8/1998 | Kronzer |
| 5,885,335 | A | | 3/1999 | Adams et al. |
| 5,981,113 | A | | 11/1999 | Christian |
| 5,988,791 | A | | 11/1999 | Miyashita et al. |
| 6,042,228 | A | | 3/2000 | Yamada et al. |
| 6,059,391 | A | * | 5/2000 | Fulkerson et al. ..... 347/2 |
| 6,087,061 | A | | 7/2000 | Hare et al. |
| 6,095,628 | A | | 8/2000 | Rhome |
| 6,117,921 | A | | 9/2000 | Ma et al. |
| 6,126,281 | A | | 10/2000 | Shimoda et al. |
| 6,132,502 | A | | 10/2000 | Yatake |
| 6,140,391 | A | | 10/2000 | Zou et al. |
| 6,156,072 | A | | 12/2000 | Usui et al. |
| 6,161,929 | A | | 12/2000 | Erdtmann et al. |
| 6,183,079 | B1 | | 2/2001 | Meade et al. |
| 6,196,674 | B1 | | 3/2001 | Takemoto |
| 6,206,516 | B1 | | 3/2001 | Moriyama et al. |
| 6,262,796 | B1 | | 7/2001 | Loopstra et al. |
| 6,267,518 | B1 | | 7/2001 | Abe |
| 6,270,189 | B1 | | 8/2001 | Miyashita et al. |
| 6,291,023 | B1 | | 9/2001 | Nigam |
| 6,300,391 | B2 | | 10/2001 | Parazak et al. |
| 6,322,620 | B1 | | 11/2001 | Xiao |
| 6,326,419 | B1 | | 12/2001 | Smith |
| 6,335,140 | B1 | | 1/2002 | Miyazaki |
| 6,341,856 | B1 | | 1/2002 | Thompson et al. |
| 6,416,923 | B2 | | 7/2002 | Miyazaki |
| 6,450,633 | B1 | | 9/2002 | Kronzer |
| 6,464,649 | B1 | | 10/2002 | Duchon et al. |
| 6,500,880 | B1 | | 12/2002 | Parazak |
| 6,513,924 | B1 | * | 2/2003 | Goldberg et al. ..... 347/106 |
| 6,536,894 | B1 | | 3/2003 | Rasmussen |
| 6,606,427 | B1 | | 8/2003 | Graves et al. |
| 6,626,530 | B2 | | 9/2003 | Snow et al. |
| 6,647,208 | B1 | | 11/2003 | Kirby |
| 6,698,874 | B2 | | 3/2004 | Katsuki |
| 6,755,518 | B2 | | 6/2004 | Codos |
| 6,785,436 | B2 | | 8/2004 | Ravikanth et al. |
| 6,840,992 | B2 | | 1/2005 | Glaum et al. |
| 6,879,378 | B2 | | 4/2005 | Morita et al. |
| 7,134,749 | B2 | | 11/2006 | Ben zur et al. |
| 2002/0009662 | A1 | | 1/2002 | Miyazaki |
| 2002/0022120 | A1 | | 2/2002 | Katsuki et al. |
| 2002/0060728 | A1 | | 5/2002 | Koizumi et al. |
| 2003/0142167 | A1 | | 7/2003 | Nakamura et al. |
| 2003/0157304 | A1 | | 8/2003 | Li et al. |
| 2003/0197750 | A1 | | 10/2003 | Iwatsuki et al. |
| 2003/0197772 | A1 | | 10/2003 | Iwatsuki et al. |
| 2003/0205159 | A1 | | 11/2003 | McNeil |
| 2004/0252173 | A1 | | 12/2004 | Ben-Zur et al. |
| 2005/0098054 | A1 | | 5/2005 | Berndtsson et al. |
| 2005/0179706 | A1 | | 8/2005 | Childers |
| 2005/0179708 | A1 | | 8/2005 | Ben-Zur |
| 2007/0103528 | A1 | | 5/2007 | Pearl et al. |
| 2007/0103529 | A1 | | 5/2007 | Pearl et al. |
| 2007/0104899 | A1 | | 5/2007 | Pearl et al. |
| 2008/0012884 | A1 | | 1/2008 | Ben-zur et al. |

FOREIGN PATENT DOCUMENTS

| | | |
|---|---|---|
| GB | 422488 | 1/1935 |
| JP | 61-075870 | 4/1986 |
| JP | 63-031593 | 6/1988 |
| JP | 05-293954 | 11/1993 |
| JP | 08-232176 | 9/1996 |
| JP | 09-039365 | 2/1997 |
| JP | 10-278379 | 10/1998 |
| JP | 11-138768 | 5/1999 |
| JP | 2002-036644 | 2/2002 |
| JP | 2003-312069 | 11/2003 |
| JP | 2004-532750 | 10/2004 |
| WO | WO 98/30749 | 7/1998 |
| WO | WO 99/56948 | 11/1999 |
| WO | WO 00/73570 | 12/2000 |
| WO | WO 01/17792 | 3/2001 |
| WO | WO 01/32974 | 5/2001 |
| WO | WO 01/49504 | 7/2001 |
| WO | WO 02/066565 | 8/2002 |
| WO | WO 02/078958 | 10/2002 |
| WO | WO 2005/076730 | 8/2005 |
| WO | WO 2005/115089 | 12/2005 |
| WO | WO 2005/115761 | 12/2005 |

OTHER PUBLICATIONS

International Search Report Dated Jan. 9, 2007 From the International Searching Authority Re.: Application No. PCT/IL05/00166.
International Search Report Dated Sep. 19, 2006 From the International Searching Authority Re.: Application No. PCT/IL0500558.
Office Action Dated Jul. 3, 2006 From the Israeli Patent Office Re.: Application No. 162231 and Its Translation Into English.
Official Action Dated Jul. 17, 2008 From US Patent and Trademark Office Re.: U.S. Appl. No. 11/606,154.
Official Action Dated Jan. 26, 2010 From the US Patent and Trademark Office Re.: U.S. Appl. No. 90/009,646.
Official Action Dated Mar. 31, 2010 From the US Patent and Trademark Office Re.: U.S. Appl. No. 11/606,242.
Response Dated Mar. 10, 2010 to Communication Pursuant to Article 94(3) EPC of Nov. 12, 2009 From the European Patent Office Re.: Application No. 05703208.8.
Response Dated Dec. 28, 2009 to Official Action of Jul. 27, 2009 From the US Patent and Trademark Office Re.: U.S. Appl. No. 11/606,242.
Third Party Request for Ex Parte Reexamination Dated Nov. 30, 2009 From the US Patent and Trademark Office Re.: Patent No. 7,134,749.
Written Opinion Dated Jan. 4, 2006 From the International Searching Authority Re.: Application No. PCT/IL05/00559.
Written Opinion Dated Jan. 9, 2007 From the International Searching Authority Re.: Application No. PCT/IL05/00166.
Written Opinion Dated Sep. 19, 2006 From the International Searching Authority Re.: Application No. PCT/IL0500558.
Wikipedia "Boehmite", Wikipedia, the Free Encyclopedia, Retrieved From the Internet, Dec. 11, 2007.
Official Action Dated Apr. 22, 2010 From the US Patent and Trademark Office Re.: U.S. Appl. No. 90/009,646.
Response Dated Jun. 16, 2010 to Official Action of Apr. 22, 2010 From the US Patent and Trademark Office Re.: U.S. Appl. No. 90/009,646.
International Preliminary Report on Patentability Dated Dec. 11, 2006 From the International Bureau of WIPO Re.: Application No. PCT/il/2005/000558.
International Preliminary Report on Patentability Dated Jul. 17, 2007 From the International Preliminary Examining Authority Re.: Application No. PCT/IL05/00166.
International Preliminary Report on Patentability Dated Nov. 26, 2007 From the International Preliminary Examining Authority Re.: Application No. PCT/IL05/00559.
International Preliminary Report on Patentability Dated Feb. 8, 2007 From the International Preliminary Examining Authority Re.: Application No. PCT/IL05/00166.
Office Action Dated Feb. 21, 2006 From the Israeli Patent Office Re.: Application No. 162231 and Its Translation Into English.
Official Action Dated Feb. 26, 2009 From the United States Patent and Trademark Office Re.: U.S. Appl. No. 10/776,163.
Official Action Dated May 7, 2009 From the US Patent and Trademark Office Re.: U.S. Appl. No. 11/588,277.
Official Action Dated Mar. 10, 2009 From the US Patent and Trademark Office Re.: U.S. Appl. No. 10/461,414.
Official Action Dated May 11, 2007 From the US Patent and Trademark Office Re.: U.S. Appl. No. 10/776,163.
Official Action Dated May 14, 2009 From the US Patent and Trademark Office Re.: U.S. Appl. No. 11/606,242.
Official Action Dated Jul. 17, 2008 From the US Patent and Trademark Office Re.: U.S. Appl. No. 11/106,154.

Official Action Dated Nov. 19, 2007 From the US Patent and Trademark Office Re.: U.S. Appl. No. 10/776,163.
Official Action Dated Aug. 20, 2008 From the US Patent and Trademark Office Re.: U.S. Appl. No. 10/776,163.
Official Action Dated Jan. 25, 2007 From the US Patent and Trademark Office Re.: U.S. Appl. No. 10/776,163.
Official Action Dated Mar. 31, 2009 From the US Patent and Trademark Office Re.: U.S. Appl. No. 11/606,154.
Official Action Dted Jun. 30, 2006 From the US Patent and Trademark Office Re.: U.S. Appl. No. 10/776,163.
Official Action Dated Feb. 12, 2008 From the US Patent and Trademark Office Re.: U.S. Appl. No. 10/776,163.
Response Dated Aug. 2, 2010 to Official Action Dated Mar. 31, 2010 From the US Patent and Trademark Office Re.: U.S. Appl. No. 11/606,242.
Office Action Dated Jul. 28, 2010 From the Israeli Patent Office Re.: Application No. 177323 and Its Translation Into English.
Official Action Dated Jul. 27, 2009 From the US Patent and Trademark Office Re.: U.S. Appl. No. 11/606,242.
Supplementary European Search Report Dated Jun. 29, 2009 From the European Patent Office Re.: Application No. 05744201.4.
Office Action Dated Aug. 18, 2010 From the Israeli Patent Office Re.: Application No. 163459 and Its Translation Into English.
Response Dated Jun. 22, 2010 to Official Action of Apr. 22, 2010 From the US Patent and Trademark Office Re.: U.S. Appl. No. 90/009,646.
Translation of Notice of Reason for Rejection Dated Sep. 28, 2010 From the Japanese Patent Office Re. Application No. 2006-552776.
Official Action Dated Oct. 19, 20108 From the US Patent and Trademark Office Re.: U.S. Appl. No. 90/009,646.
Communication Pursuant to Article 94(3) EPC Dated Nov. 12, 2009 From the European Patent Office Re.: Application No. 05703208.8.
International Preliminary Report on Patentability Dated Dec. 14, 2006 From the International Bureau of WIPO Re.: Application No. PCT/il/2005/000558.
Notice of Allowance Dated Jul. 30, 2009 From the US Patent and Trademark Office Re.: U.S. Appl. No. 10/776,163.
Office Action Dated Aug. 26, 2009 From the Israeli Patent Office Re.: Application No. 177323 and Its Translation Into English.
Office Action Dated Jul. 17, 2008 From the US Patent and Trademark Office Re.: U.S. Appl. No. 11/606,154.
Response Dated Dec. 10, 2009 to Office Action of Aug. 26, 2009 From the Israel Patent Office Re.: Application No. 177323.
Supplementary European Search Report Dated Aug. 26, 2009 From the European Patent Office Re.: Application No. 05703208.8.
Official Action Dated Jul. 17, 2007 From the US Patent and Trademark Office Re.: U.S. Appl. No. 11/606,154.
Official Action Dated Jan. 25, 2007 From the US Patenbtand Trademark Office Re.: U.S. Appl. No. 10/776,163.
Official Action Dated Feb. 26, 2009 From the United States Patent and Trademark Office Re.: U.S. Appl. No. 10/776,163.
Official Action Dated Jul. 27, 2009 From the US Patent and Trademark Office Re.: U.S. Appl. No. 11/606,242.
Official Action Dated Jun. 30, 2006 From the US Patent and Trademark Office Re.: U.S. Appl. No. 10/776,163.
Oficial Action Dated Feb. 12, 2008 From the US Patent And Trademark Office Re.: U.S. Appl. No. 10/776,163.
Office Action Dated Dec. 7, 2010 From the Israel Patent Office Re. Application No. 179765 and Its Translation Into English.
Response Dated Nov. 28, 2010 to Office Action of Jul. 28, 2010 From the Israeli Patent Office Re.: Application No. 177323.

* cited by examiner

43
X-AXIS
Y-AXIS
55

43
55

43
55

43
55

DIGITAL PRINTING APPARATUS

RELATED APPLICATIONS

This application is a National Phase Application of PCT Patent Application No. PCT/IL2005/000166 having International Filing Date of Feb. 10, 2005 which claims Priority from Israel Patent Application No. 162231, filed on May 30, 2004, and U.S. patent application Ser. No. 10/776,163, filed on Feb. 12, 2004. The contents of the above Application are all incorporated herein by reference.

FIELD AND BACKGROUND OF THE INVENTION

The present invention relates to printing and, more particularly, but not exclusively to digital printing.

Common printing methods employ liquid ink made of a pigment and an adhesive in a liquid, volatile, solvent. The liquid ink is applied to the printed substrate using a brush, pipe, stylus, rolling ball or cylinder, by sprinkling droplets such as an ink jet printer, by means of a printing pad or an offset stencil, by forcing the ink through a mesh stencil such as used with screen printing, etc.

Printing using liquid ink requires that the ink remains at the point it is applied to the printed substrate until the solvent evaporates. When liquid ink is applied to substrates that are either absorbing, such as cloth, paper and cardboard, or have a high surface tension with the solvent, such as polished metal and glass, the liquid ink is smeared through or over the printed substrate creating a poor image quality Garment printing is performed today by screen printing press systems that are complex, inflexible, and require a specific set-up for each different print and color. First, an image file undergoes a mechanical spot-color separation process (each color is printed in black and white on a separate sheet of paper or film). Then, the image is "developed" in a long optical process, into a fine mesh (screen), which is pressed during the printing process against the media. Before printing, each screen has to be set in the proper station and adjusted with reference to the other screens. Ink is transferred to the garment through the mesh by mechanical means (generally wiping a squeegee along the screen). Garment screen-printing technology requires a special press station for each color level. Print quality is limited due to the high registration requirements between stations; hence printing resolution is relatively low.

An attempt has been made to provide a device for printing onto a portion of a substrate, such as a garment. U.S. Pat. No. 6,095,628 describes and claims an apparatus for inkjet printing pre-programmed viewable indicia onto a substrate. The apparatus is essentially a conventional ink jet printer, and is capable of creating the indicia through ink jet ink depositing upon flat or rigid substrates as a result of controlled platen movement beneath the ink jet printer head and controlled ink jet printer head movement and ink flow control by a programmed CPU. The flexible printing substrate of the patented invention is larger than the platen and portions of the substrate are draped downwardly over edges of the platen and tucked under the platen.

When printing on garments it is particularly important to limit the penetration of the ink into the depth of the fabric, which causes dull coloring of the garment.

There is thus a widely recognized need for, and it would be highly advantageous to have, a printing system devoid of the above limitations.

SUMMARY OF THE INVENTION

According to one aspect of the present invention there is provided a digital printing machine including a rigid frame, a first linear motion X axis stage mounted on the frame, a second linear motion X axis stage mounted on the frame parallel to the first axis stage, and arranged for operation independently of the first axis stage, a printing table assembly movable on each linear X axis stage, a linear motion Y axis stage mounted on the frame perpendicular to the linear X axis stages, above the printing table assemblies, and an array of inkjet nozzles mounted on the linear Y axis stage for linear motion perpendicular to the X axis stage.

According to one embodiment of the invention, each printing table assembly includes a media-holding plate and an openable cover pivotally coupled to the media-holding plate for holding the media firmly against the plate.

Further according to the invention, the printing machine further includes a curing unit located above each printing table assembly and arranged to cure ink on media on the printing table assembly.

Still further according to the invention, the printing machine further includes an ironing unit located above each printing table assembly and arranged to iron media on the printing table assembly before printing thereon.

There is also provided, according to the present invention, a printing machine including a rigid frame, a linear motion X axis stage mounted on the frame, a printing table assembly movable on the linear X axis stage, a linear motion Y axis stage mounted on the frame perpendicular to the linear X axis stage, above the printing table assembly, an array of inkjet nozzles mounted on the linear Y axis stage for linear motion perpendicular to the X axis stage, a curing unit located above the printing table assembly and arranged to cure ink on media on the printing assembly, and an ironing unit located above the printing table assembly and arranged to iron media on the printing assembly before printing thereon.

According to one embodiment, the curing unit is an infrared system. According to an alternative embodiment, the curing unit is a hot air blowing unit.

There is also provided according to the present invention a printing machine including a rigid frame, a linear motion X axis stage base mounted on the frame, a first printing table assembly movable on the linear X axis stage base, a second printing table assembly movable on the linear X axis stage base independently of the first printing table assembly, a linear motion Y axis stage mounted on the frame perpendicular to the linear X axis stages, above the printing table assemblies, and an array of inkjet nozzles mounted on the linear Y axis stage for linear motion perpendicular to the X axis stage.

Additionally, in accordance with a preferred embodiment of the present invention, there is provided a printing system for printing on a surface for use with a printing head controllably mounted for printing onto selected locations of the surface and a controllable wetting mounted for wetting the selected locations prior to printing.

There is also provided in accordance with a preferred embodiment of the present invention a printing system for printing on a surface for use with at least one printing apparatus comprising at least one ink applicator operative to print an image over at least a part of the surface, and at least one wetting apparatus comprising at least one liquid applicator operative to apply a wetting composition over at least a portion of the part of the surface prior to printing, using a wetting composition that is capable of interfering with the engagement of a liquid ink composition with at least one binding site of the surface. Preferably, the printed image is a photograph.

There is further provided in accordance with a preferred embodiment of the present invention a printing system further comprising at least one controller operative to control the at least one liquid applicator to apply the wetting composition onto selected parts of the surface.

There is yet further provided in accordance with a preferred embodiment of the present invention a printing system for use with a liquid applicator that includes least one of a spraying nozzle, a dripping nozzle, a droplet injector, a drop-on-demand piezoelectric inkjet nozzle, a continuous piezoelectric inkjet nozzle, a roller pad, an offset printing stencil and a screen printing stencil.

There is still further provided in accordance with a preferred embodiment of the present invention a printing system for use with at least one ink applicator that includes at least one of a spraying nozzle, a dripping nozzle, a droplet injector, a drop-on-demand piezoelectric inkjet nozzle, a continuous piezoelectric inkjet nozzle, a roller pad, an offset printing stencil and a screen printing stencil.

There is additionally provided in accordance with a preferred embodiment of the present invention a printing system including at least one retractable bath carrying a thinner liquid, the thinner liquid operative to prevent the wetting composition from drying within the liquid applicator, the retractable bath positioned beneath the liquid applicator and operative to be retracted on demand to expose the liquid applicator to apply the wetting composition onto the surface.

Preferably, the thinner liquid is based on the wetting composition.

Preferably, the thinner liquid is aqueous.

In accordance with a preferred embodiment of the present invention, the printing system also includes a curing unit located above each the printing table assembly and arranged to cure at least one of the wetting composition and the ink deposited on the printable medium mounted on the printing table assembly. Preferably, the curing unit is an infrared system. Alternatively, the curing unit is a hot air blowing unit.

In accordance with a preferred embodiment of the present invention, the printing system also includes an ironing unit located above each the printing table assembly and arranged to iron media on the printing table assembly.

In accordance with another preferred embodiment of the present invention, the surface to be printed by the printing system is made of fibrous material, porous material, or a material that has a high surface tension with the liquid ink. Preferably, the fibrous material is a textile fabric. Preferably, the fabric consists of wool, silk, cotton, linen, hemp, ramie, jute, acetate, acrylic, lastex, nylon, polyester, rayon, viscose, spandex, metallic composite, carbon or carbonized composite, or any combination thereof. Preferably, the textile fabric comprises a garment.

In accordance with a further preferred embodiment of the present invention, the printing system constructed of a rigid frame, at least one linear motion X-axis mounted on the frame, at least one table assembly operative to bear a printable medium and movable on each linear X-axis, a bridge mounted on the frame perpendicular to the linear X-axis and above the table assembly, at least one liquid applicator mounted on the bridge and operative to apply a wetting composition onto the printable medium mounted on the table assemblies, a linear motion Y-axis stage mounted on the frame perpendicular to the linear X-axis and Y-axis stages and above the printing table assembly, and at least one ink applicator mounted on the linear Y-axis stage for linear motion perpendicular to the X-axis stage. Preferably the wetting composition is capable of interfering with the engagement of the liquid ink with at least one binding site of the surface of the printable medium.

In accordance with yet another preferred embodiment of the present invention, each printing table assembly includes a media-holding plate and an openable cover pivotally coupled to the media-holding plate for holding the media firmly against the plate. Preferably, at least a part of each the printing table assembly is a vacuum table.

In accordance with a still another preferred embodiment of the present invention, the media-holding plate includes a raised portion, and the cover includes a window of the same shape and slightly larger than the raised portion.

Additionally, in accordance with a preferred embodiment of the present invention, the linear motion X-axis stage is a linear motor driven stage. Preferably, the linear motion Y-axis stage is a linear motor driven stage.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
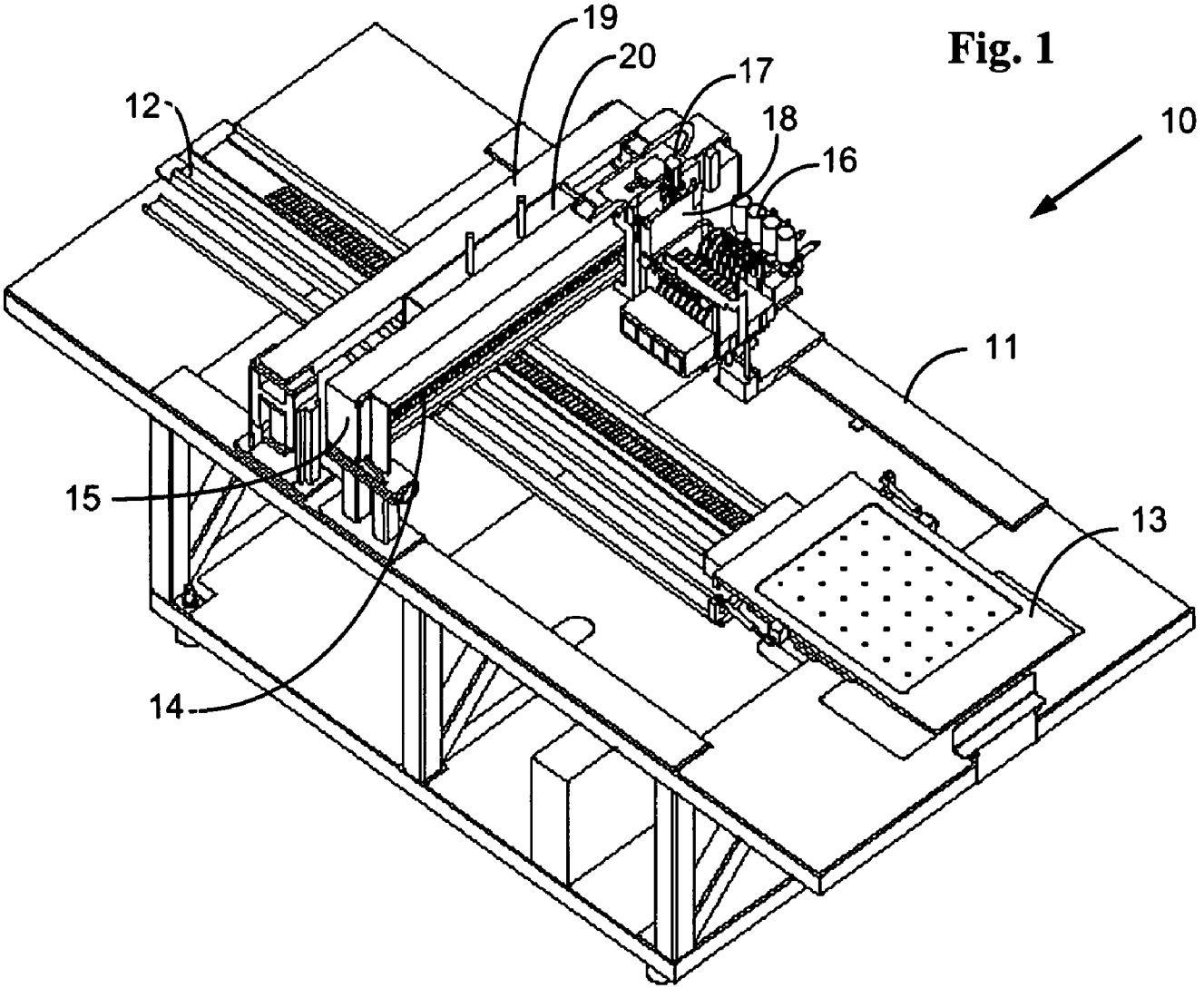
FIG. 1 is a simplified perspective drawing of a garment printing system constructed and operative in accordance with one embodiment of the present invention.

The principles and operation of a printing apparatus according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The present invention relates to a digital printing system for various substrates that permits accurate, high quality, high resolution, multi-color printing directly onto a substrate in a relatively simple system. A preferred embodiment of the present invention is useful for printing over materials that usually cause the ink to smear over the material, such as fibrous materials, porous materials and other ink absorbing materials, and materials having high surface tension with the ink liquid. A preferred embodiment of the present invention is thus provided for the garment industry in general, and for T-shirt printing industry in particular.

A preferred embodiment of the present invention comprises

A pre-printing assembly for wetting the substrate prior to printing. This wetting sub-system typically comprises an array of spraying nozzles operative to apply a wetting composition over the printed material. This wetting composition interferes with the engagement of the ink with the printed material so as to limit the spread of the ink over, or within, the material;

A printing assembly comprising at least one printing head operative to apply ink on the printed material;

A garment handling assembly;

Optionally, at least one curing assembly, operative to cure the wetting composition, or the ink liquid, or both;

Optionally, at least one ironing assembly, operative to iron the garment prior to printing or wetting; and A controller unit for controlling the operation of the above assemblies, typically comprising a computer, preferably comprising a microcontroller, or a programmable logic controller (PLC), or a personal computer (PC) or any combination thereof.

The abovementioned wetting assembly and printing assembly preferably comprises of one or more units capable of applying liquid over selected areas of the material to be printed. Such units are known in the art as spraying nozzles, dripping nozzles, droplet injectors, drop-on-demand piezoelectric inkjet nozzles, continuous piezoelectric inkjet nozzles, roller pads, stamping pads, offset printing stencil and a screen printing stencil, etc.

The abovementioned garment handling assembly preferably comprises an accurate X, Y, Z motion system and a printing table. Since the printing system is particularly suited to printing on a garment, it has been described herein with respect to garment printing, by way of example only. However, it will be appreciated that any other suitable substrate can alternatively be utilized.

A preferred embodiment of a digital printing system according to the present invention typically comprises electronically controlled wetting and printing units such as spraying nozzles, dripping nozzles, droplet injectors, drop-on-demand piezoelectric inkjet nozzles, continuous piezoelectric inkjet nozzles, etc. that are capable of creating image pixels in a controllable manner.

A preferred embodiment of the present invention shown and described below comprises the combination of wetting by spraying technology and printing by inkjet technology. It is appreciated that the present invention pertains to every possible combination of wetting technology and printing technology.

The digital printing system has the following advantages over conventional screen-printing devices:

The image file is received in conventional format without the need for spot color separation process.

No screen or stencil development is needed.

The transition from one job to another does not require replacement of screens, cleaning, etc.

Printing flexibility: the image can be modified for each print. Variable data is printed at the same speed.

The image can be printed in a variety of color levels.

The system occupies a smaller floor area.

Higher printing resolution can be achieved.

Printing files are stored efficiently in a way that eliminates the need for large screen storage area and screen cleaning processes.

Printing directly onto a garment or textile obviates the need for transfer paper and an additional transfer step.

Reference is now made to FIG. 1, which is a simplified perspective drawing of a garment printing system 10 constructed and operative in accordance with one embodiment of the present invention. The garment printing system 10 comprises a rigid frame 11 in which an accurate linear motion X-axis stage 12 is installed. According to one embodiment, the X-axis stage 12 is a linear motor driven stage, and can be a conventional linear stage. Alternatively, the X-axis stage 12 can be any other type of linear stage, like a belt-driven stage, or ball screw driven stage. A printing table assembly 13 is connected to the X-axis stage 12, which preferably provides high acceleration and scanning speed.

Perpendicular to the X-axis direction, an accurate linear motion Y-axis stage 14 is installed above the printing table assembly 13, preferably on a bridge 15. The X-axis 12 and the Y-axis 14 stages are known in the art as linear stages, such as linear rails, like rails marketed by THK Co., Ltd., Tokyo, Japan, a linear encoder like that sold by RSF Elektronik Ges.m.b.H., Tarsdorf, Austria, and a moving plate supported on the rails. According to a preferred embodiment of the invention, the X-axis stage 12 is a linear motor driven stage, capable of high acceleration rate and stiffness, for example, Anorad brand model LW10 of Rockwell Automation, Shirley, N.Y., USA. Closed loop control is responsible for the high accuracy and motion smoothness. The position of the printing table 13 along the rails of the X-axis stage 12 is measured by a linear encoder, and is used also to determine the firing timing of the inkjet nozzles and the wetting nozzles. The Y-axis stage 14 is preferably a linear motor stage similar to the X-axis stage 12.

A printing head 16, preferably comprising a plurality of inkjet nozzles, is connected to a vertical Z-axis system 17, which is preferably a ball screw driven stage. The Z-axis stage 17 is supported on an Y-axis moving plate 18, to allow motion perpendicular to the direction of movement of the printing table 13. The gap between the printing heads array 16 and the printed surface on the printing table assembly 13 is an important parameter for high quality printing. The Z stage 17 enables movement of the printing heads array 16 in the vertical direction for calibration for different media heights.

It is appreciated that any other ink applying apparatus can be used for the printing head 16, such as a dripping nozzle, a droplet injector, a drop-on-demand piezoelectric inkjet nozzle, a continuous piezoelectric inkjet nozzle, a roller pad, an offset printing stencil and a screen printing stencil.

It is also appreciated that, while the system is particularly suited for printing on a finished garment, other media can alternatively be employed. The present invention will be described with regard to a finished garment, for ease of description by way of example.

The printing system 10 optionally comprises an ironing unit 19 and also optionally comprises a curing unit 20. The ironing unit 19 is preferably supported on the frame 11 above the X-axis stage 12, preferably on a bridge, such that the printing table assembly 13 can move underneath. The ironing unit 19 prepares the media for printing, as will be further explained in detail below. The curing unit 20 is preferably supported on the bridge 15 over the rigid frame 11. Alternatively, the curing unit 20 can be mounted over a separate bridge in a similar manner to the ironing unit 19. According to one embodiment of the present invention the curing unit 20 is an infrared heating unit that evaporates the ink carrier as printing is accomplished or during print passes. According to another embodiment of the present invention the curing unit 20 is a hot air blower. Alternatively, any other curing unit can be utilized, which is suited to the type of ink printed on the garment.

A main computer 21, preferably a microprocessor, controls the entire system, and is coupled to each of the various units for coordination, synchronization, and activation, in accordance with a pre-programmed printing process. Main computer 21 coordinates a large number of functions. It receives images from an image file, processes the images to be printed, activates the curing unit, and controls the motion systems, the ironing unit, and more. Preferably, movement of the X-axis and the Y-axis stages is coordinated by the microprocessor with the nozzles firing command by a print heads controller, so that precise printing of a desired object or symbol can be performed. In a preferred embodiment of the present invention, computer 21 is augmented with a programmable logic controller (PLC), later shown and described in accordance with FIG. 4.

Figures 2A, 2B, 2C:
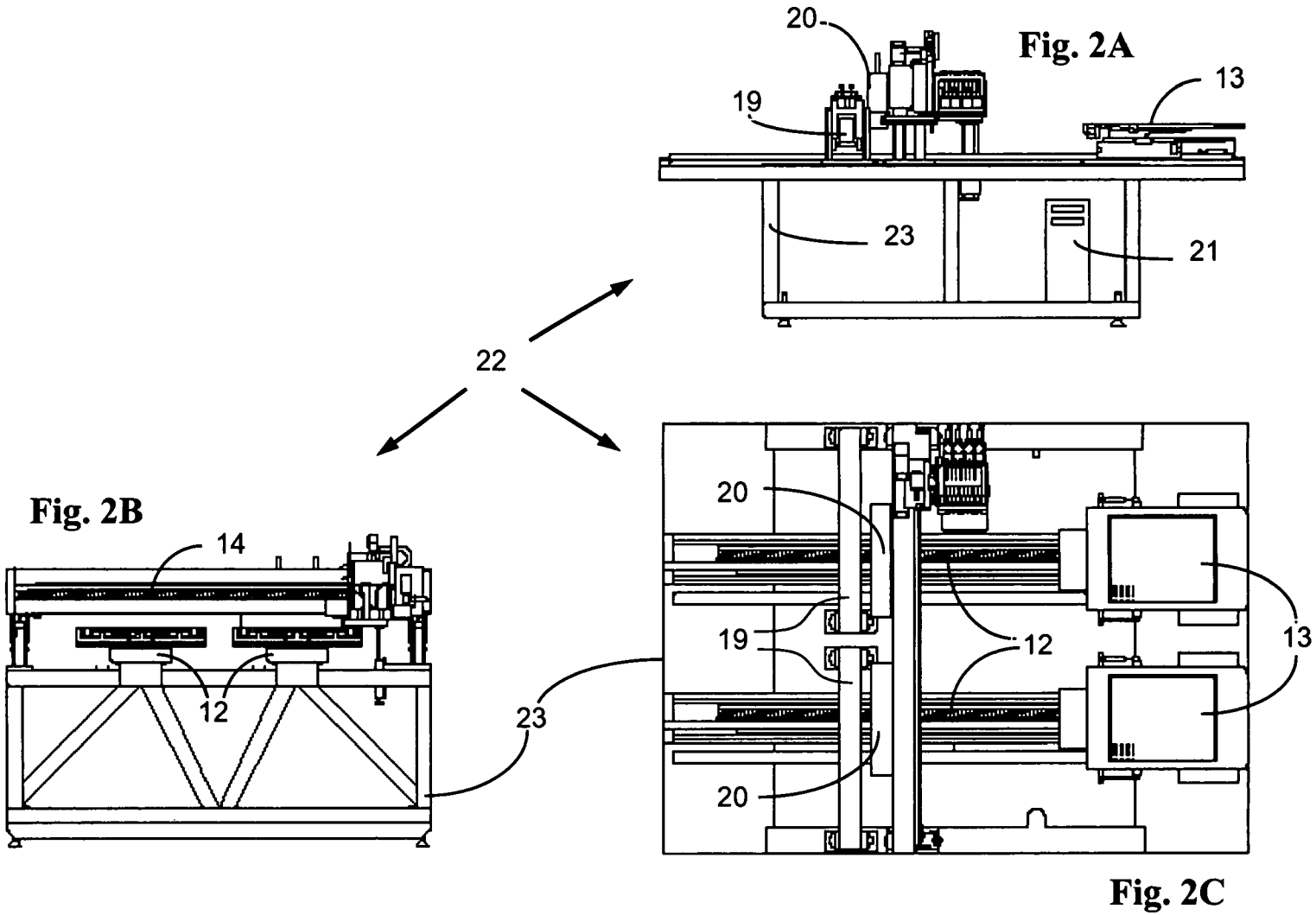
FIG. 2A, FIG. 2B and FIG. 2C are respectively side, front and top simplified views of a garment printing system constructed and operative in accordance with another embodiment of the present invention.

Reference is now made to FIG. 2A, FIG. 2B, and FIG. 2C, which are respectively side, front and top simplified views of a garment printing system 22 constructed and operative in accordance with another embodiment of the present invention. The printing system 22 comprises a frame 23 that is wider than frame 11 shown in FIG. 1, and two independent linear X-axis stages 13 are installed instead of one X-axis stage, as in the embodiment described in FIG. 1. Y-axis stage 14 described in FIGS. 2A, 2B and. 2C is substantially the same as Y-axis stage 14 in FIG. 1. The printing system 22 also comprises two curing units 20, two ironing units 19 and two printing table assemblies 13. It is a particular feature of the present embodiment that the two X-axis stages 12 operate independently from one another. Thus, the process of loading and unloading can be carried out on one printing assembly at the same time that printing is being carried out on the second printing assembly. As a result, the printing heads array is working substantially continuously, dramatically improving throughput of the system. Each table can be accessed from the same edge of the system, thereby permitting a single worker to operate two printing assemblies. Main computer 21 controls both X-axis stages for independent operation.

Figure 3:
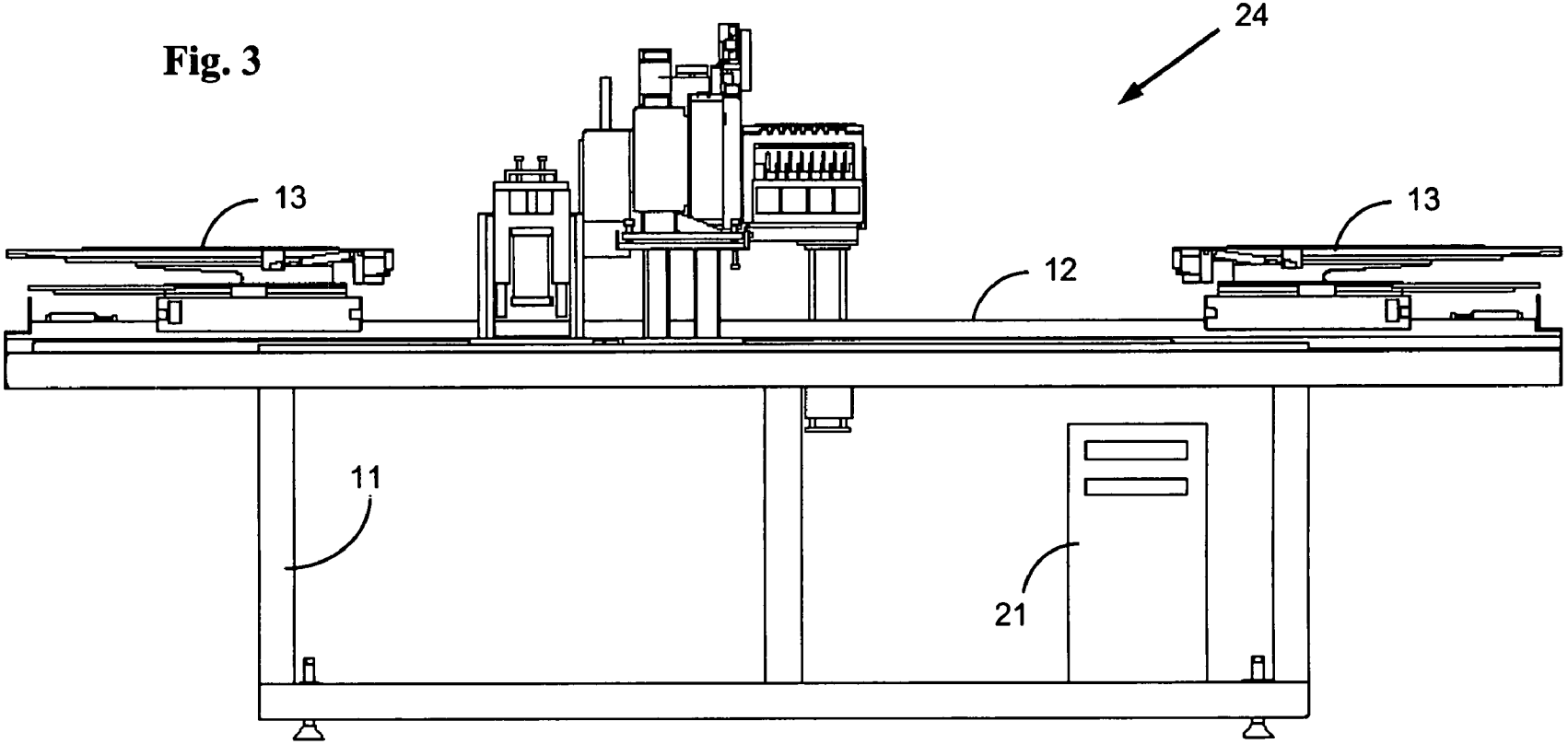
FIG. 3 is a simplified side view drawing of a garment printing system constructed and operative in accordance with a further embodiment of the present invention.

Reference is now made to FIG. 3, which is a side view of a printing system 24 according to a yet another embodiment of the present invention. The printing system 24 comprises a frame 11, which is the same as frame 11 shown in FIG. 1 and two independently movable printing table assemblies 13 mounted on the same X-axis stage 12. The printing table assemblies 13 are capable of moving back and forth independently of one another. Printing is performed on one printing table 13 while at the same time garments are unloaded and loaded on the second printing table. Each printing table 13 is accessed from the opposite edge of the system, and is loaded and unloaded by a different operator. Main computer 21 controls both printing tables.

Figure 4:
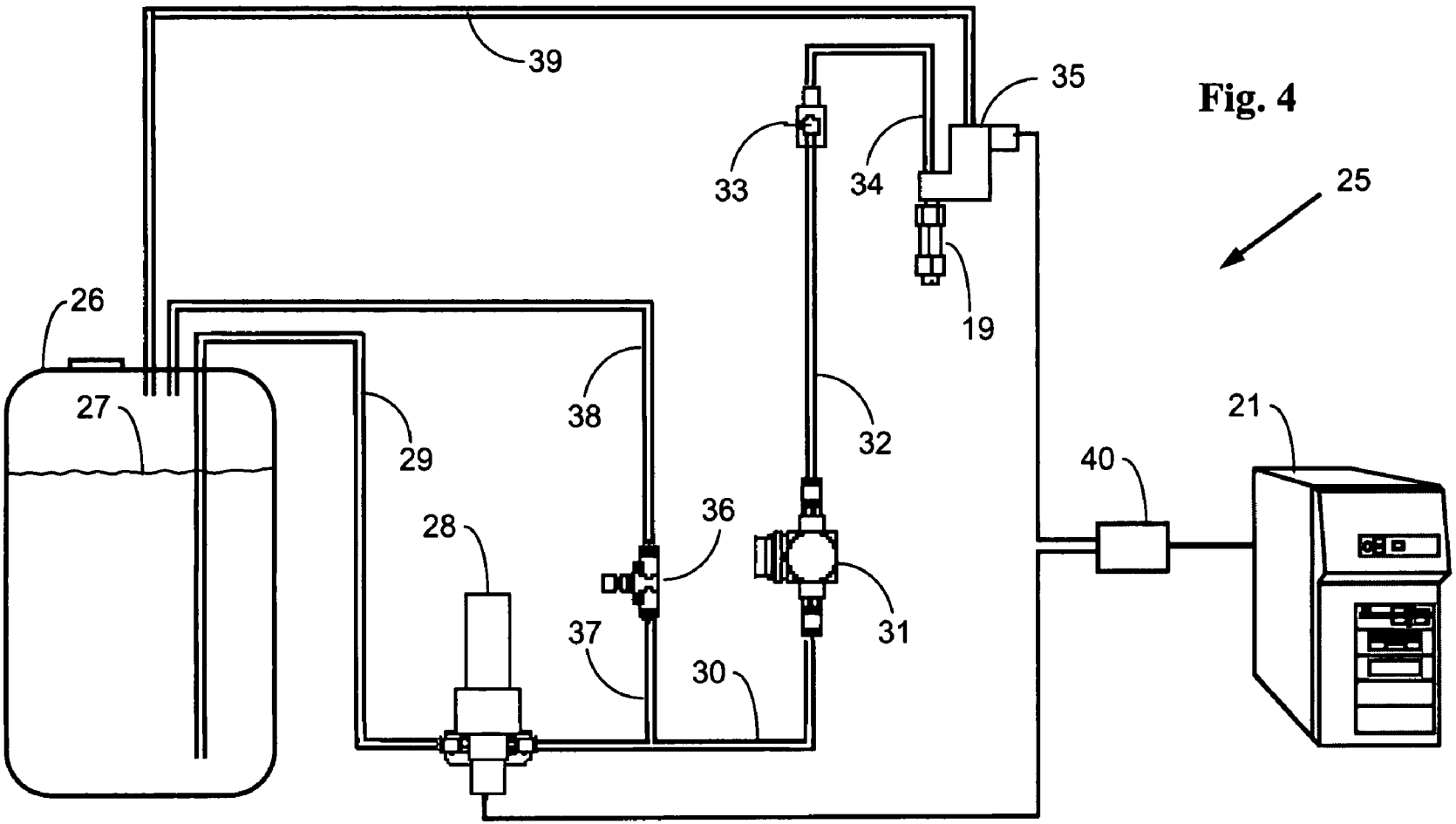
FIG. 4 is a schematic illustration of a wetting system constructed and operative in accordance with one embodiment of the present invention.

Reference is now made to FIG. 4, which is a schematic illustration of a wetting system 25 constructed and operative in accordance with one embodiment of the present invention. The wetting system 25 can be added to a printing system, such as the printing systems 10, 22 and 24 described above. In a preferred embodiment of the present invention the wetting system 25 comprises a tank 26 containing the wetting composition 27, a pump 28, such as MGC4-MGC11DC available from Fluid-o-Tech of 23 via Morimondo, Milan, Italy, connected to the tank 26 through a pipe 29 and operative to pump the wetting composition 27 from the tank 26 to the spraying nozzle 19, such as 1101, available form Teejet, PO Box 7900, Wheaton, Ill., USA, via pipe 30, pressure regulator 31, such as CM004R01, available form Camozzi, S.p.A. Via Eritrea 20/I, 25126 Brescia—Italy, pipe 32, manifold 33, pipe 34 and solenoid valve 35. Overflow needle valve 36, such as GS0462216, available from Serto A.G., 25 Schutzenstr, CH-8355 Aadorf, Switzerland, is operative to carry excess wetting composition back to the tank 26 via pipes 37 and 38. Pipe 39 is also operative to carry overflow wetting composition from the solenoid valve 35 to the tank 26. Preferably, a plurality of solenoid valves 35 and spraying nozzles 19 are constructed to form a battery of spraying nozzles as will be described below. When wetting is initiated, as will be described below, the computer 21, preferably with the aid of a programmable logic controller (PLC) 40, activates the pump 29, and then solenoid valve 35, to inject streams of the wetting composition 27. In a preferred embodiment of the present invention shown and described in accordance with FIG. 4 and FIG. 15, the role of the PLC is to translate the commands effected by the computer 21 into electrical activation to the relevant components. A detailed description of the computer 21 procedure to operate the wetting system 25 is further shown and described below with reference to FIG. 15.

It is appreciated that the wetting the garment prior to printing limits the penetration of the ink into the garment so that a larger amount of ink remains on the external, visual, layers of the fabric, and that the printing head is thereafter capable of creating smaller dots of ink. Therefore the printed image has a higher quality, through higher resolution and stronger colors.

It is also appreciated that the method and the apparatus for wetting the garment can be alternatively used to coat any other surface that is capable of absorbing the ink, or that has a relatively high surface tension with the ink liquid, so as to limit the smearing of the ink through, or over, the surface.

It is further appreciated that the spraying nozzle 19 can be replaced by other means for applying liquid onto a surface, such as a dripping nozzle, a droplet injector, a drop-on-demand piezoelectric inkjet nozzle, a continuous piezoelectric inkjet nozzle, a roller pad, an offset printing stencil and a screen printing stencil.

It is additionally appreciated that the printing head 16 can be replaced by other means for applying ink onto a surface, such as a dripping nozzle, a droplet injector, a drop-on-demand piezoelectric inkjet nozzle, a continuous piezoelectric inkjet nozzle, a roller pad, an offset printing stencil and a screen printing stencil, in any possible combination of wetting technology and printing technology. Such possible combinations include, but are not limited to:

Wetting using dripping and printing using drop-on-demand piezoelectric inkjet nozzle;

Wetting using roller pad and printing using continuous piezoelectric inkjet nozzle;

Wetting using spraying and printing using screen printing stencil; and

Wetting using droplet injector and printing using inkjet nozzle.

Figure 5:
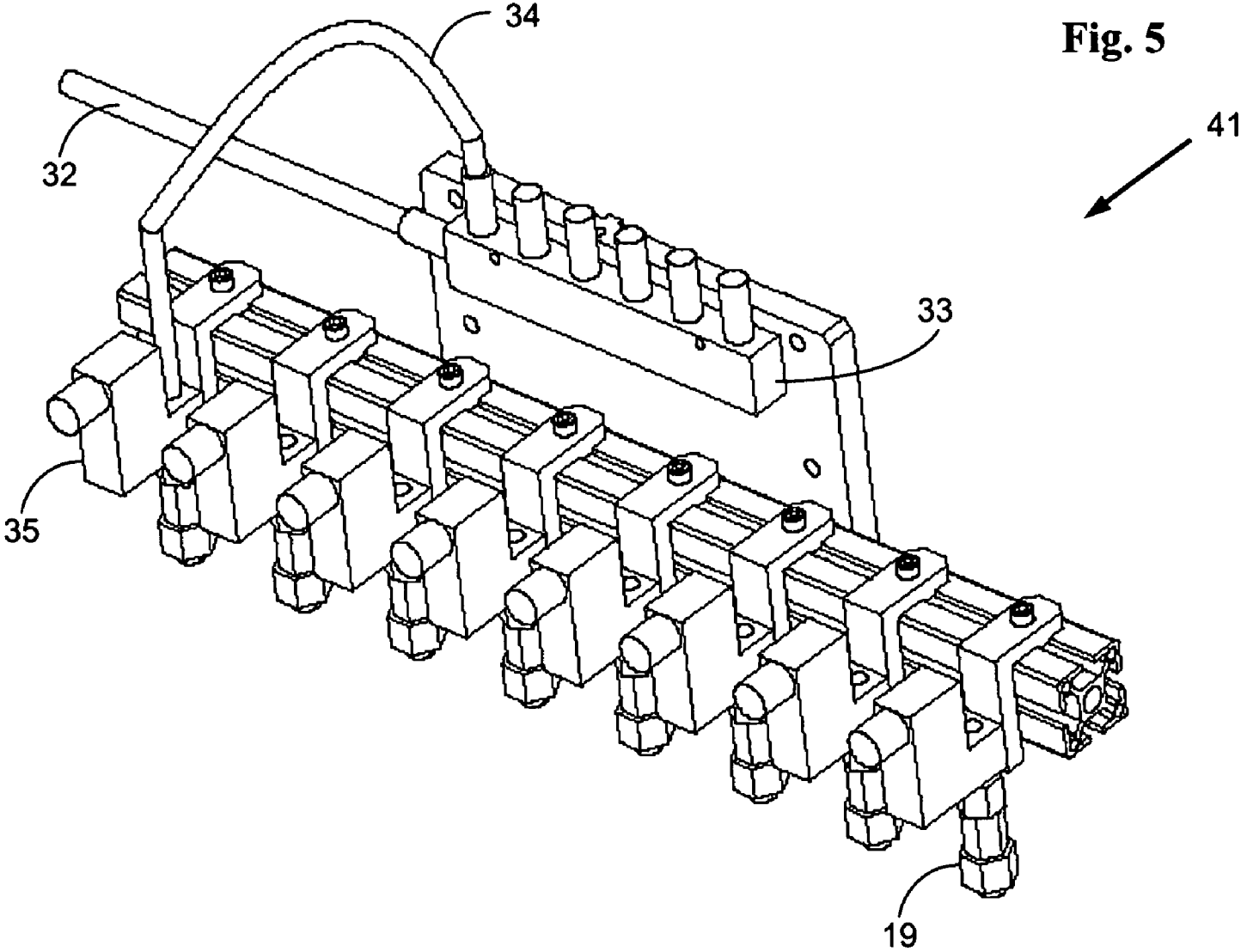
FIG. 5 is a perspective drawing of a wetting battery of solenoid valves and spraying nozzles.

Reference is now made to FIG. 5, which is a perspective drawing of a battery 41 of solenoid valves 35 and spraying nozzles 19, constructed and operative in accordance with one embodiment of the present invention. The solenoid valves 35 are each connected via the pipe 34, the manifold 33 and the pipe 32 to the pressure regulator 31 (not shown in this figure).

Figure 6:
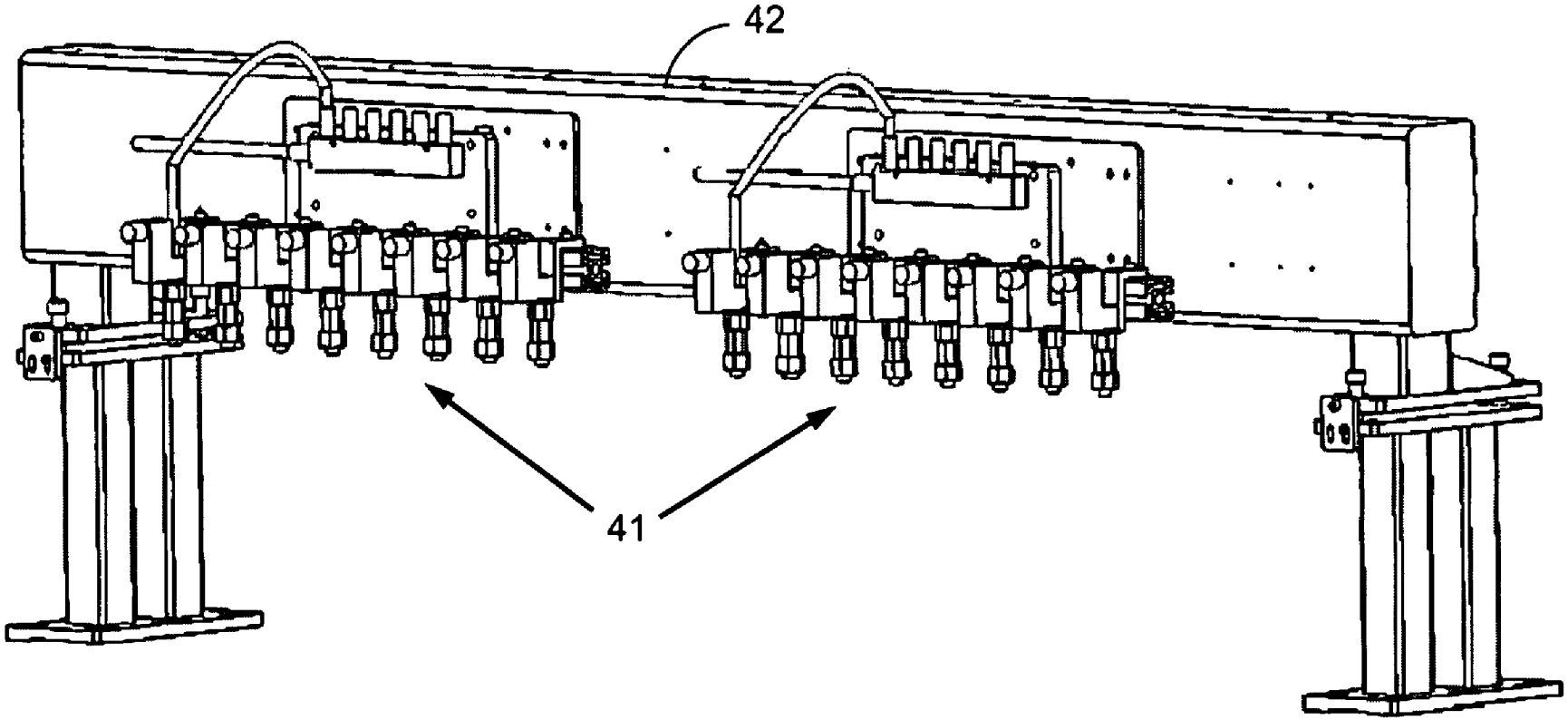
FIG. 6 is a perspective drawing of two wetting batteries mounted over a bridge.

Reference is now made to FIG. 6, which is a perspective drawing of two batteries 41, mounted over a bridge 42 constructed and operative in accordance with one embodiment of the present invention. It is appreciated that alternatively the batteries 41 can be mounted on bridge 15 of FIG. 1 and FIGS. 2A, 2B and 2C, preferably at the opposite side of the printing head 16.

Figure 7:
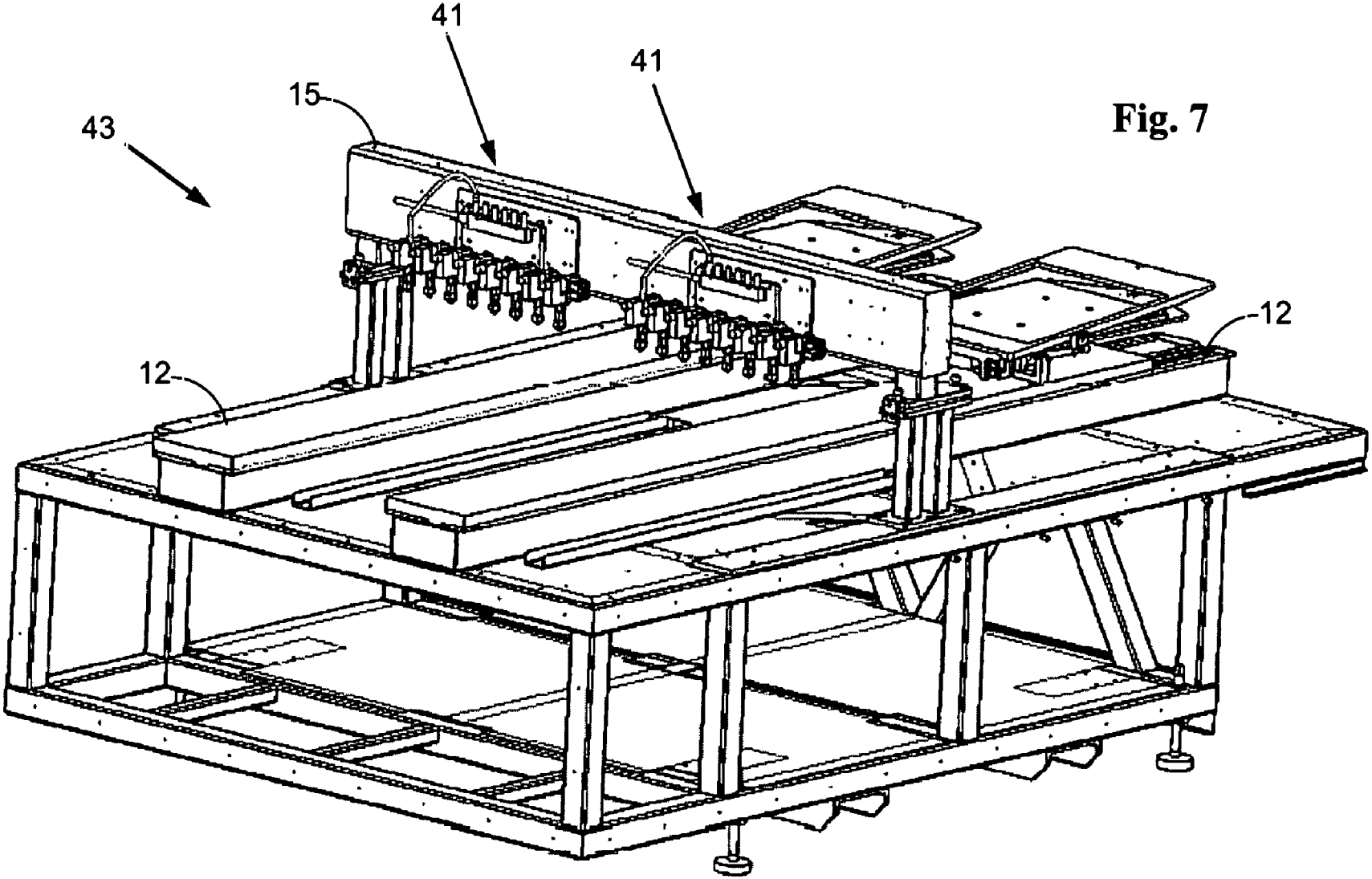
FIG. 7 is a simplified perspective drawing of the printing system of FIGS. 2A, 2B and 2C equipped with the wetting system of FIG. 4.

Reference is now made to FIG. 7, which is a simplified perspective drawing of a printing system 43 constructed and operative in accordance with one embodiment of the present invention. The printing system 43 is an improvement of the printing systems 10, 22 and 24 as shown and described in accordance with FIGS. 1, 2A, 2B, 2C and 3 by adding the pre-printing wetting assembly 25. For simplicity, printing system 43 is shown and described as an improvement of the twin axis printing system 22 shown and described in accordance with FIGS. 2A, 2B, 2C. FIG. 7 shows the two batteries 41 mounted over the bridge 15, each battery over its respective X-axis 12. Each battery 41 is operative, separately and independently, to spray a wetting composition over the garment prior to printing, as will be described below.

After mounting the garment on the printing table 13, as will be described in further details below, the operator instructs the computer 21 to start the printing process. The computer 21, with the aid of the PLC 40, moves the printing table 13, under the battery 41, until one edge of the area to be printed is placed directly below the battery 41. Then the computer 21 and the PLC 40 operate the adequate spraying nozzles 19, while moving the printing table 13 beneath, until at least a part of the area to be printed is wetted. Preferably all and only the area to be printed is wetted. Preferably the spraying nozzles are operated intermittently to apply adequate amount of wetting composition to the wetted area. At this stage the garment is ready for printing and the printing table 13 is moved under the printing head 16 to commence printing as will be described below.

It is appreciated that the operation of selected spraying nozzles 19 while moving the garment below enables the wetting of only selected areas of the garment, particularly those areas to be printed, while other areas are left intact.

Optionally the computer 21, with the aid of the PLC 40, operate the curing assembly 20 while moving the printing table underneath, to cure, at least partially, the wetting composition, prior to printing.

It is appreciated that the wetting assembly 25, as well as the printing system 43, can be easily modified for printing objects other than garments.

Figure 8:
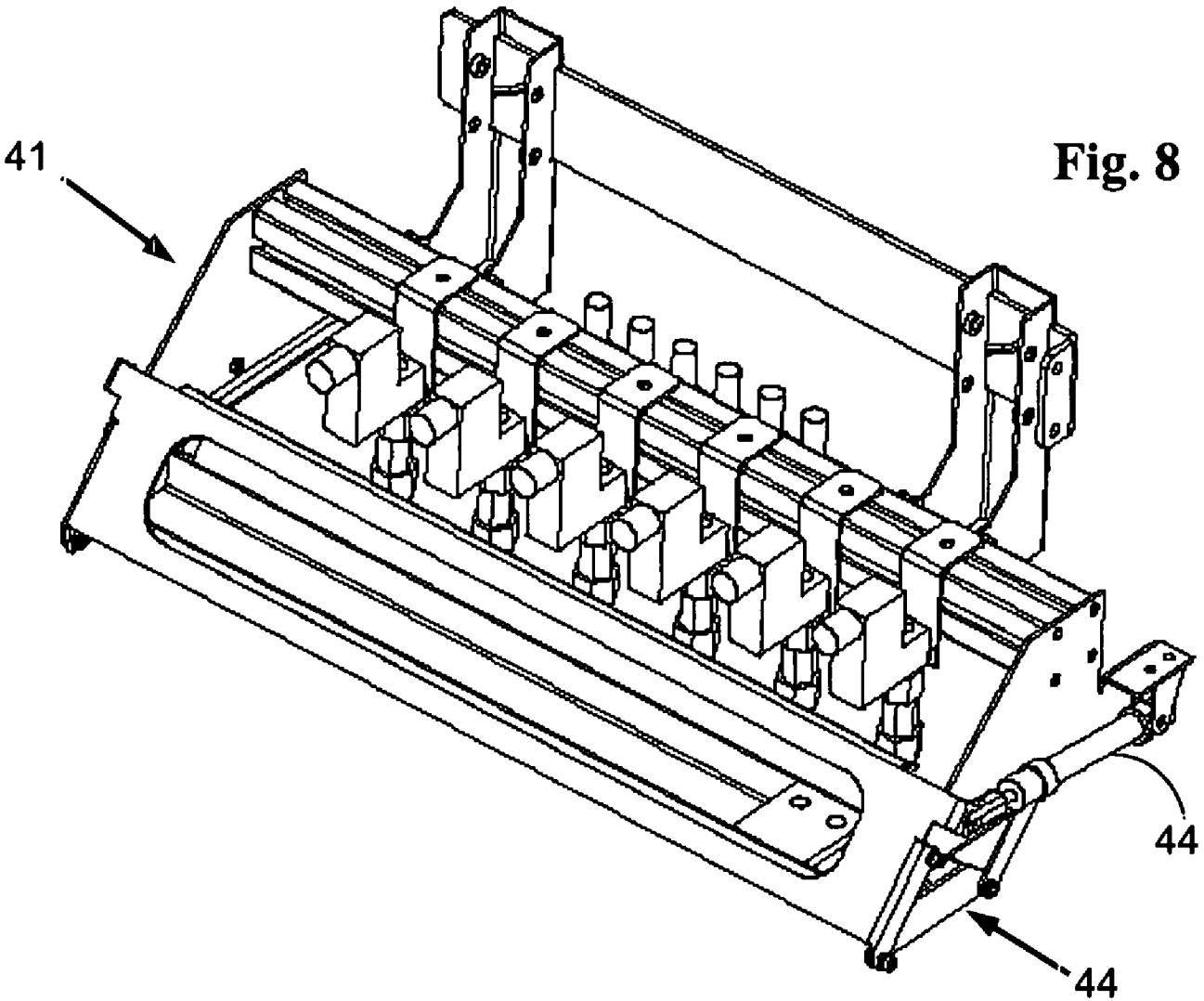
FIG. 8, FIG. 9A and FIG. 9B are simplified perspective drawings of a preferred embodiment of the battery of FIG. 5 equipped with a bath of thinner liquid.
Figure 9B:
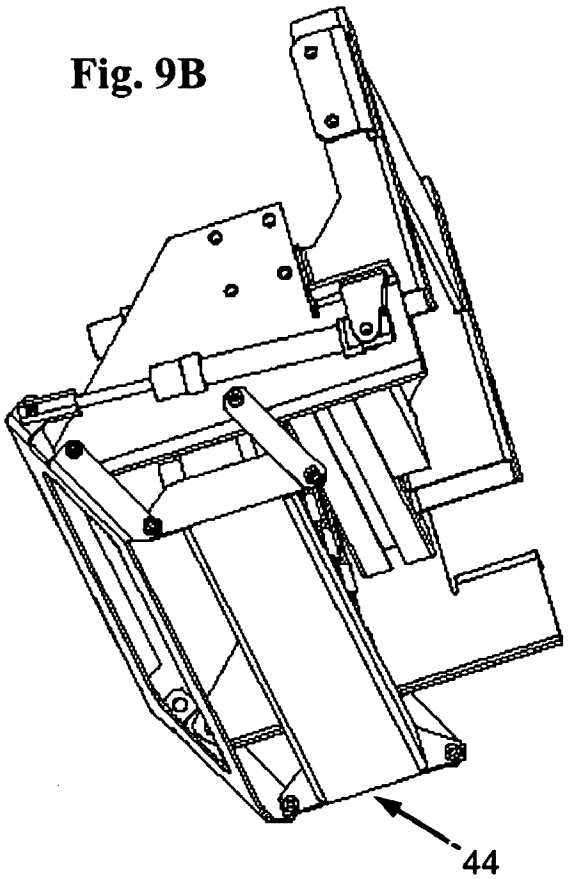
Figure 9A:
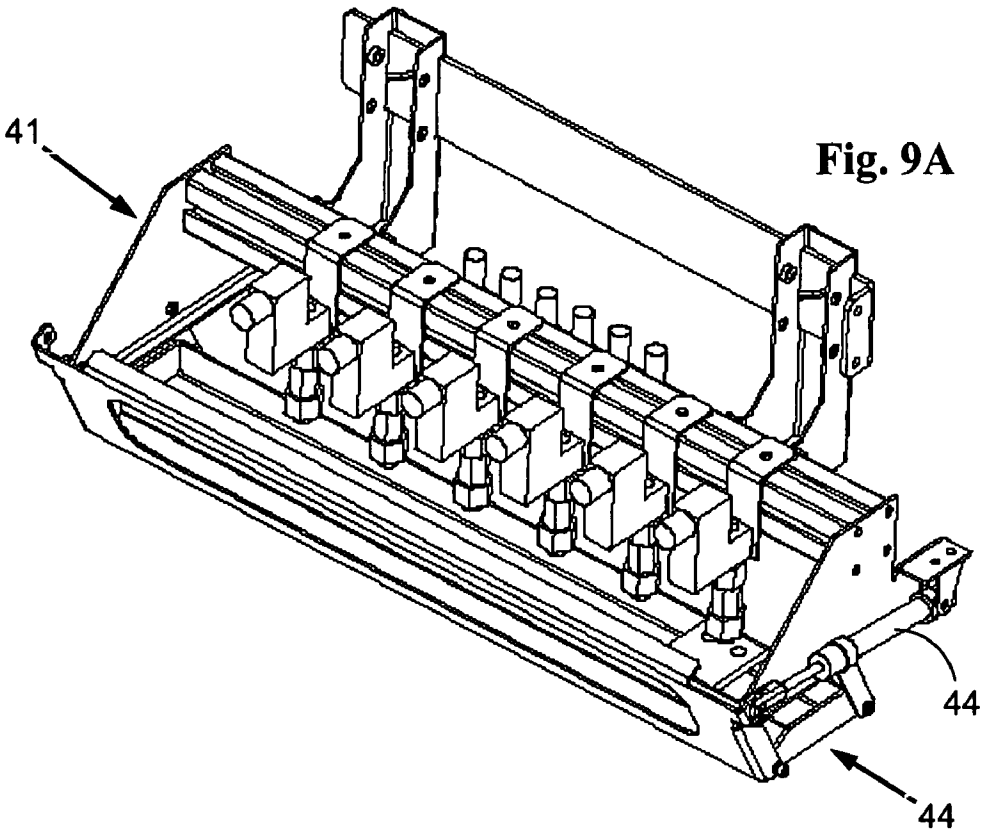

Reference is now made to FIG. 8, FIG. 9A and FIG. 9B, which are all simplified perspective drawings of a preferred embodiment of the battery 41 equipped with a bath 44, constructed and operative in accordance with one embodiment of the present invention. The bath 44 is contains a thinner liquid, and is operative to dip the tips of the spraying nozzles 19 in this thinner liquid when the spraying nozzles are not spraying, as can be seen in FIG. 8. Before spraying is initiated, the computer 21 activates the solenoid 45, also from Camozzi, to move the bath 44 and expose the tips of the spraying nozzles 19, as can be seen in FIGS. 9A and 9B.

Figure 10:
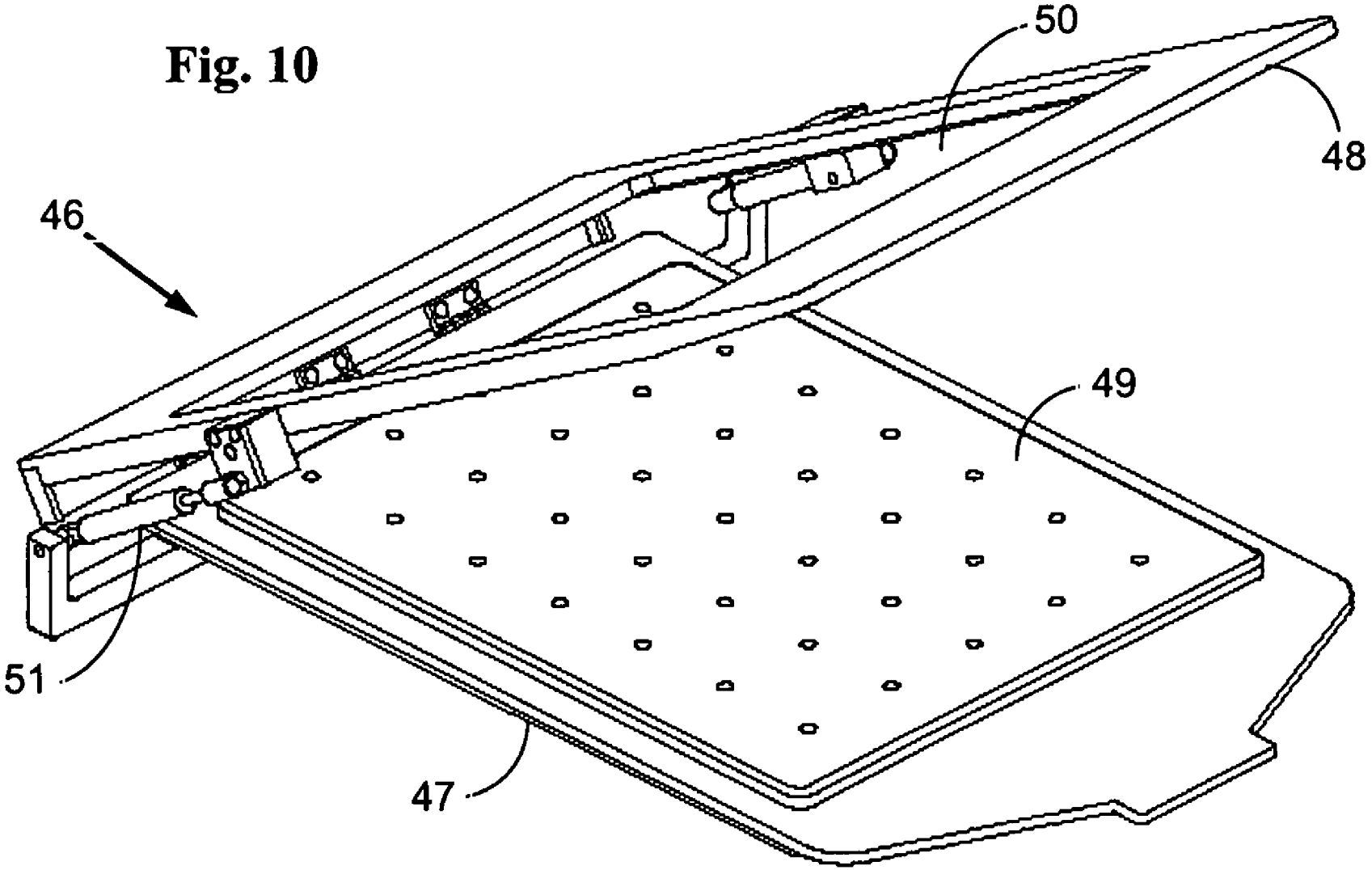
FIG. 10 is simplified perspective drawings of a preferred embodiment of a garment mounting assembly.

Reference is now made to FIG. 10, which is simplified perspective drawings of a preferred embodiment of a garment mounting assembly 46, which is a part of the printing table 13, constructed and operative in accordance with one embodiment of the present invention. The garment mounting assembly 46 comprises a media-holding plate 47 and an openable cover 48. Preferably, the media-holding plate 47 includes a raised portion 49 of the same size as the image to be printed, and the cover 48 includes a window 50 of the same shape as raised portion 49. Preferably, the window 50 is slightly larger in size, preferably a few millimeters, than raised portion 49. The cover 48 is held in an open position by two gas cylinders 51, as known in the industry. Preferably, at least part of the printing table assembly, for example the raised portion 40, is a vacuum table, to allow holding of non-porous media such as paper, boards, plastic etc.

Figure 11:
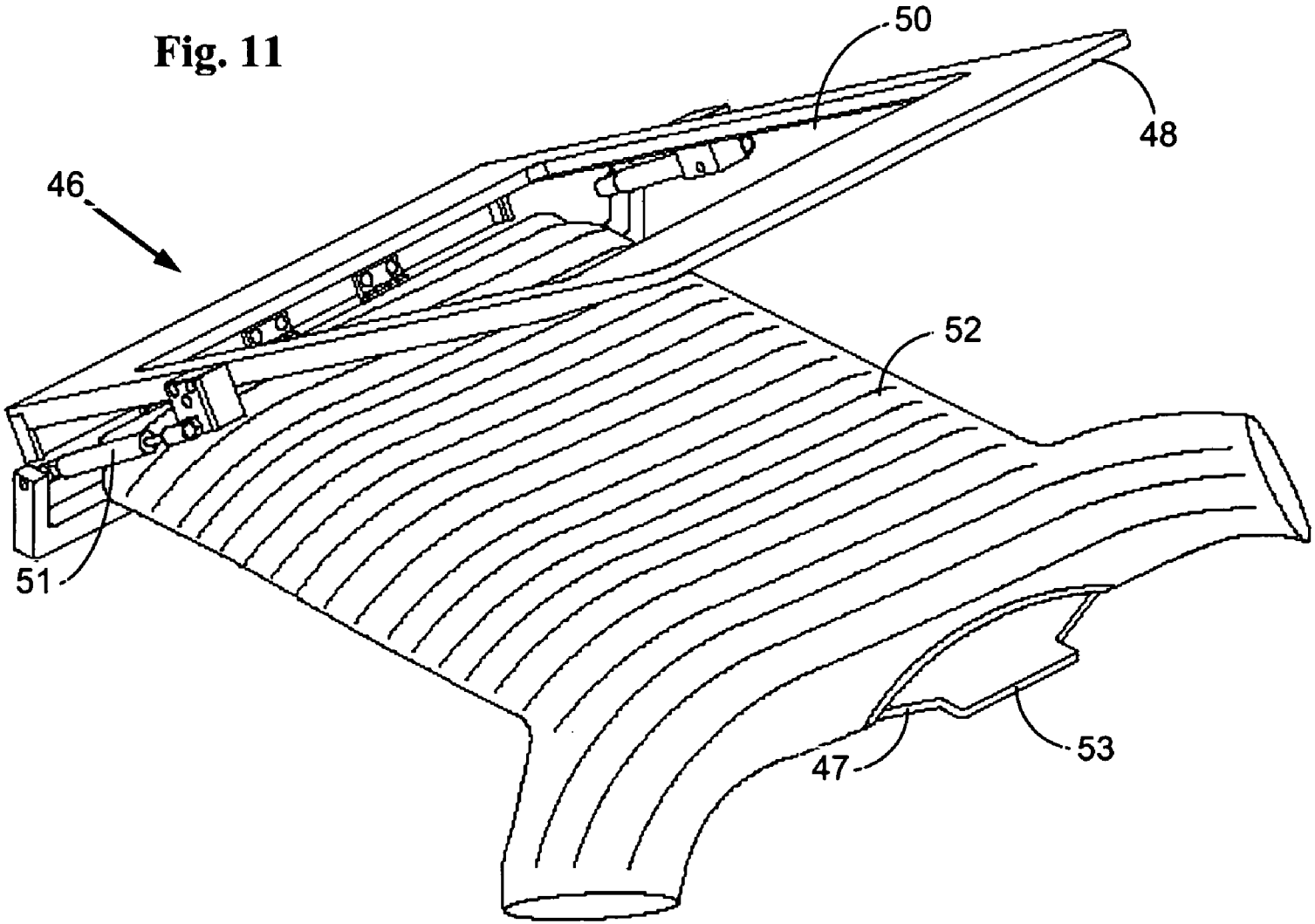
FIG. 11 and FIG. 12 are simplified perspective drawings of the garment mounting assembly of FIG. 10 with a mounted garment in an open and a close position.
Figure 12:
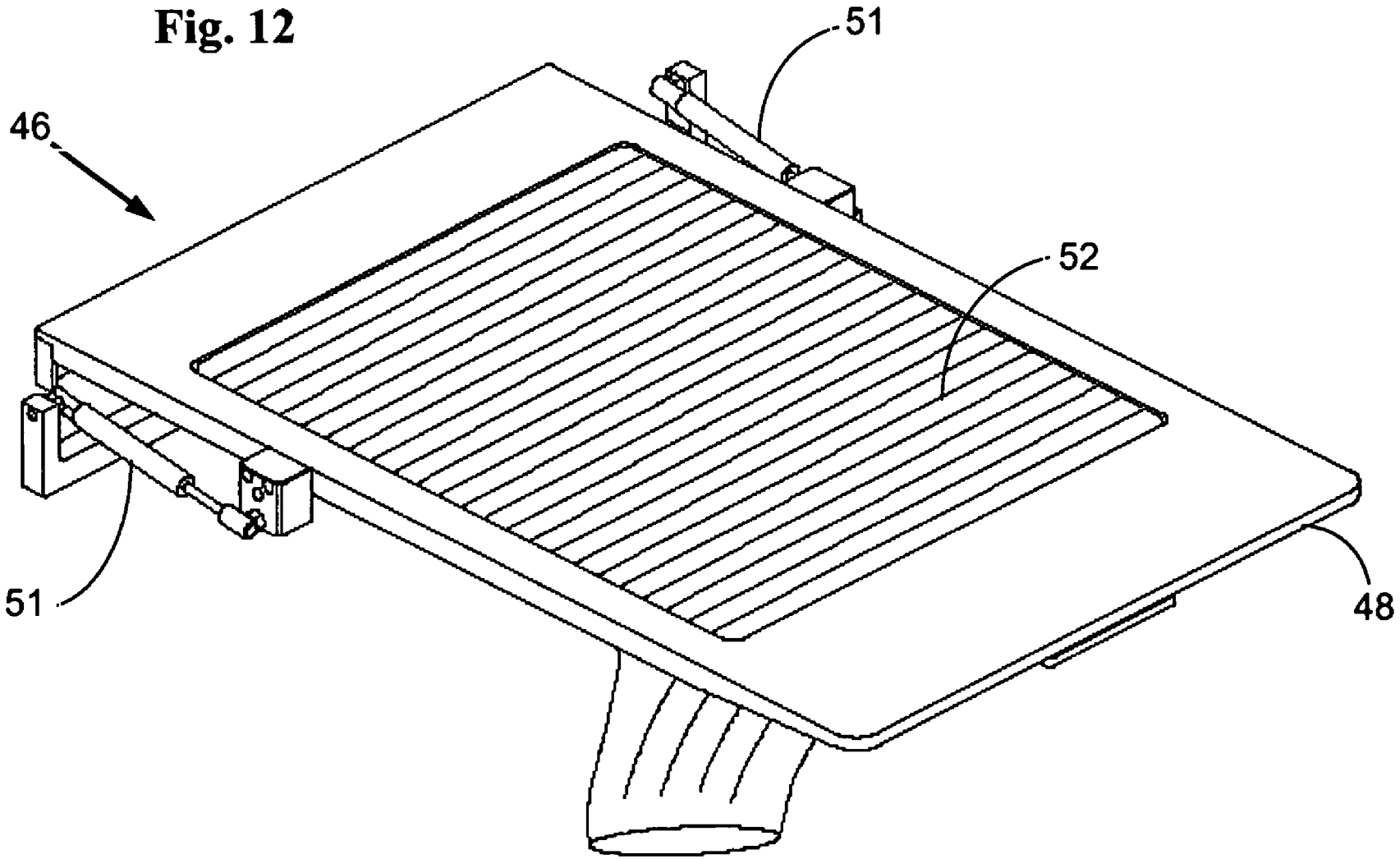

Reference is now made to FIG. 11 and FIG. 12, which are simplified perspective drawings of the garment mounting assembly 46, with a mounted garment, in an opened and a closed positions, constructed and operative in accordance with one embodiment of the present invention. FIG. 11 shows a garment 52 loaded onto the garment mounting assembly 46. Garment 53 is loaded manually onto the media-holding plate, as the plate's chamfers 53 center the garment on the plate. As can be seen in FIG. 12, after the garment 53 is loaded onto the media-holding plate, the cover 48 is closed against the media-holding plate, while gas cylinders 51 urge the cover to the closed orientation. The edges of the garment are stretched slightly by the cover surface that touches the table's lower surface around the raised portion. As a result, the garment is held firmly in place to allow high-resolution printing (i.e., there is substantially no movement of the media during printing or wrinkling).

According to another embodiment of this invention, the garment mounting assembly is a simple, flattened plate, made of aluminum or wood on which a textile piece or a garment is positioned. Flattened plates are well known by those who are familiar with the garment printing industry.

Figure 13:
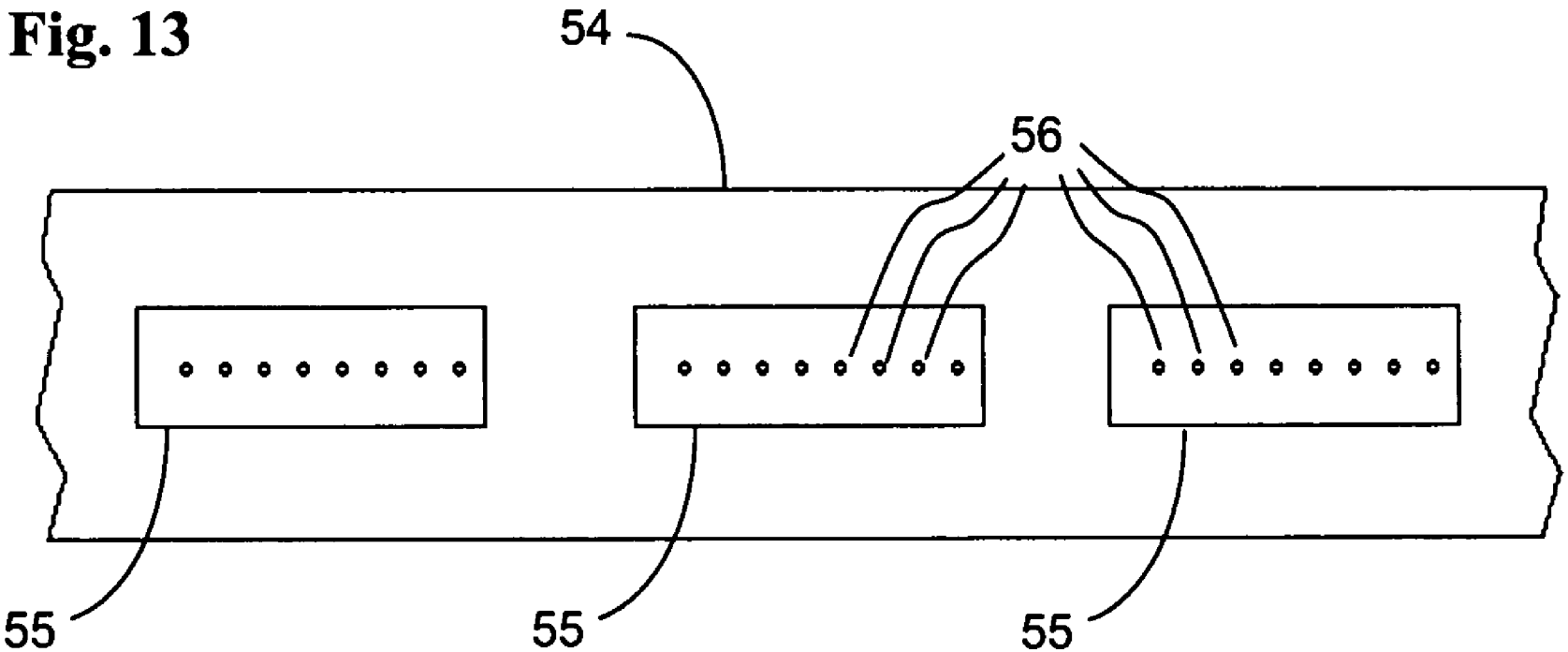
FIG. 13 is a simplified schematic drawing of an inkjet printing head assembly.
Figures 14A, 14B, 14C, 14D:
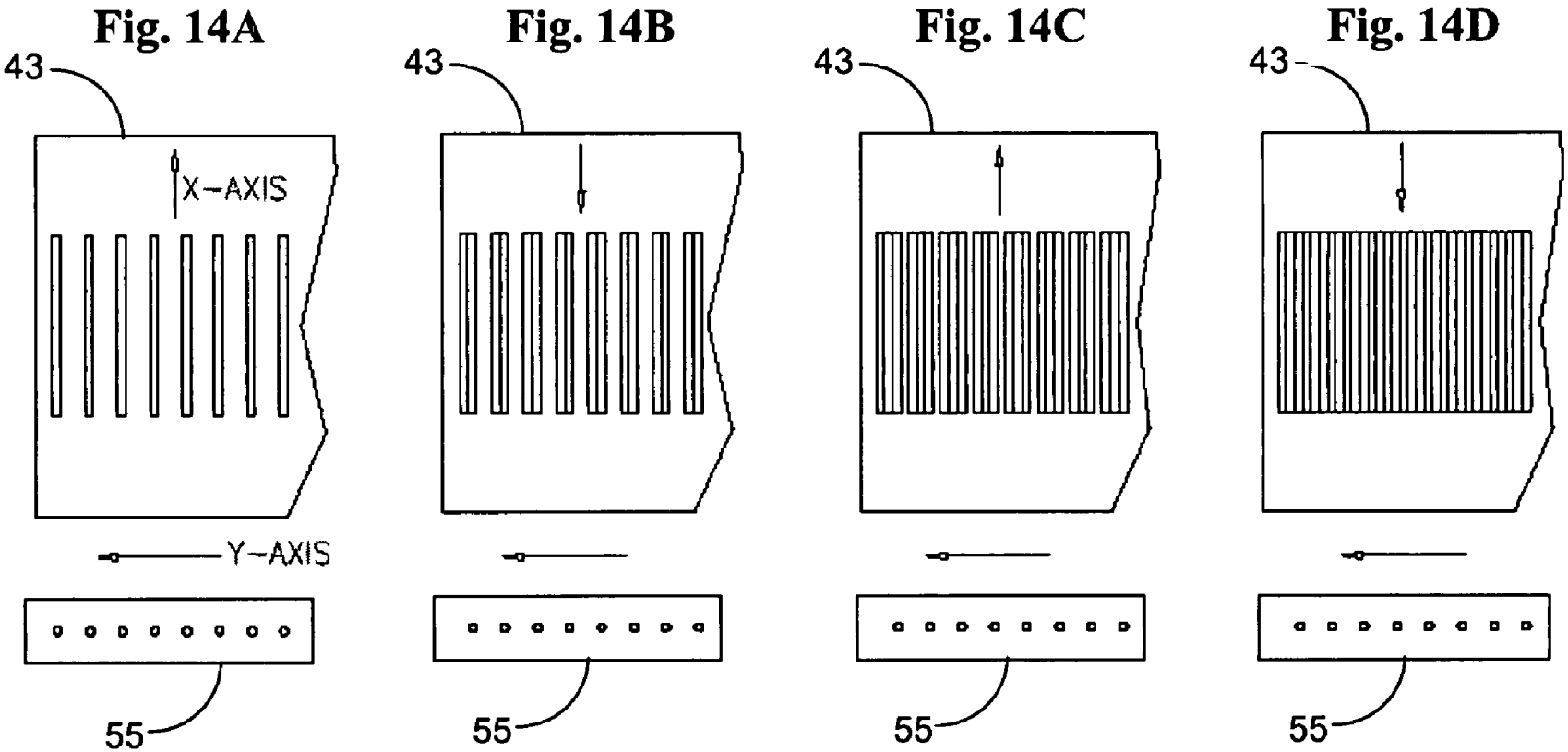
FIG. 14A, FIG. 14B, FIG. 14C, and FIG. 14D, taken together, are simplified schematic illustrations of several stages of the printing process, according to a preferred embodiment of the present invention.

Reference is now made to FIG. 13, which is a simplified schematic drawing of an inkjet printing head assembly 54, constructed and operative in accordance with one embodiment of the present invention. Printing head assembly 54 comprises an array of printing heads 55, arranged for printing directly on a finished garment, a textile piece or other flexible or rigid medium. Each printing head 55 comprises at least one inkjet nozzle 56. Printing head 55 can be any conventional printing head, such as those marketed by Spectra, Inc., New Hampshire, USA and others known in the industry.

According to one preferred embodiment of the invention, printing heads assembly 54 is a massive array of conventional piezoelectric drop-on-demand or continuous inkjet heads, which perform the high-speed printing. It is a particular feature of the present invention that at least a 500, and preferably several thousands (i.e., 2,000) nozzles are provided for simultaneous printing, resulting in a very quick and accurate process. Each printing head 55 consists of dozens of nozzles 56 that are controlled independently by main computer 21, optionally via PLC 40.

Reference is now made to FIG. 14A, FIG. 14B, FIG. 14C and FIG. 14D, which, taken together, are simplified schematic illustration of several stages of the printing process, according to a preferred embodiment of the present invention. FIGS. 14A, 14B,14C and 14D, show four consecutive passes of a part of a garment, such as garment 53 shown in FIG. 12, under a single print head, such as the print head 56 of FIG. 13.

According to a preferred embodiment, the distances between nozzles and between printing heads are bigger than the printing resolution, hence several print passes are needed to complete the image. After each pass in the X-axis, here created by movement of the printing table assembly with media 53, the printing head 55 moves incrementally in the Y-axis to prepare for the next pass. It will be appreciated that the computer 21 is programmed to control the relative motion of the printing heads and the printing table assembly so as to obtain this accurate and complete coverage.

The printing process is performed while relative motion occurs between the printing heads array 55 and the printing table assembly. At least two axes of motion are needed for this multi-color printing: X-axis motion that is in the printing direction; and Y-axis motion that is perpendicular to the printing direction. As stated above, the distances between nozzles and between printing heads are bigger than the printing resolution, hence several print passes are needed to complete the image. This is accomplished by moving the printing table assembly back and forth along the X-axis while moving the heads array perpendicular to the line of printing. The X-axis is the printing line and the Y-axis is the line on which the printing heads array moves after each pass to fill the gaps between printed lines in the next pass. Multi-color printing is performed as the table surface passes below the drop-on-demand inkjet nozzles array.

According to an alternative embodiment of the invention, the Y-axis is the fast-moving axis, while the X-axis moves incrementally to permit filling in of the gaps between printed lines.

A printing command is sent by the printing heads driver (not shown) to each nozzle at the exact time and location for ink firing. The printing command is actually an electronic pulse, with exact width, voltage level, rise time and decay time. Printing heads drivers are commercial systems known in the industry, such as Inca drivers, of IncaDigital Printers, Cambridge, England. When printing is completed, the printing table is moved to a loading position. Then, the printed garment is unloaded and a new garment is loaded onto the printing table.

Figure 15:
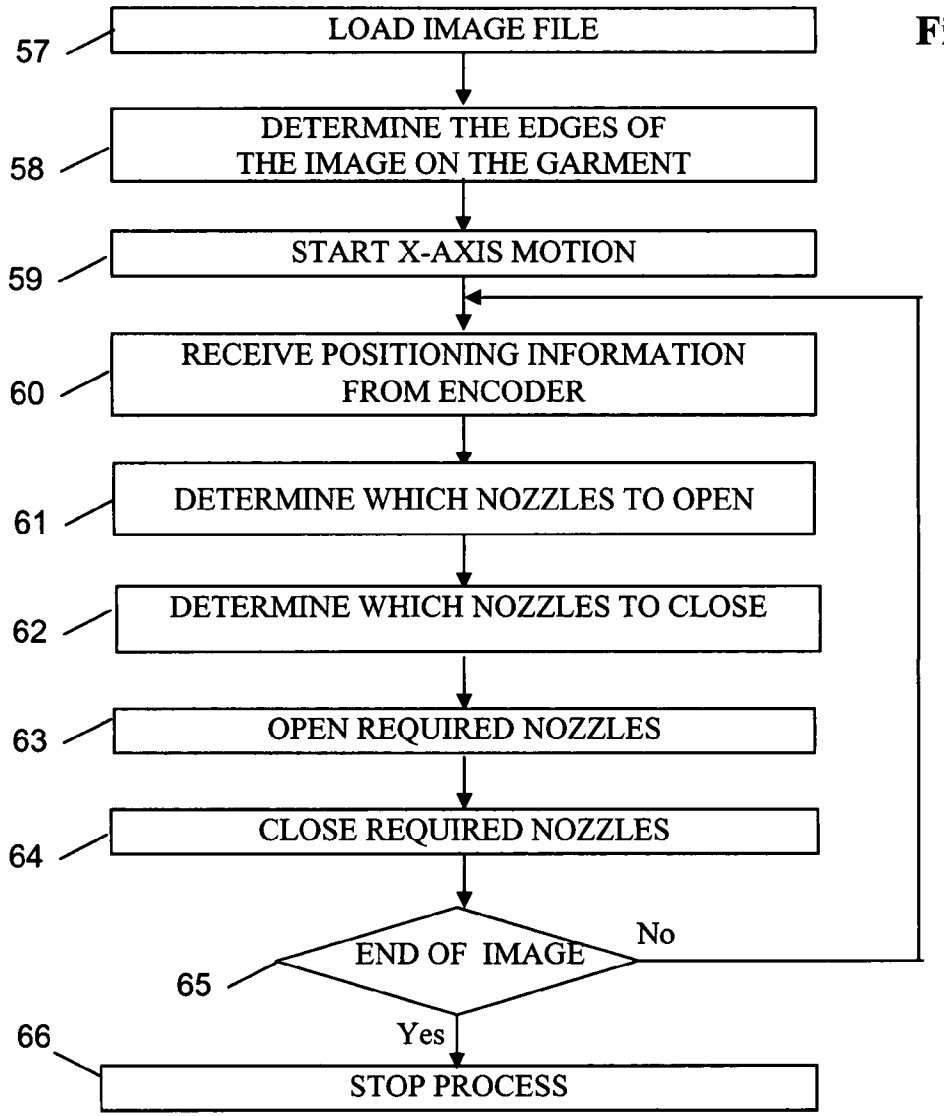
FIG. 15 is a simplified flow chart of the process of wetting the garment prior to printing.

Reference is now made to FIG. 15, which is a simplified flow chart of the process of wetting the garment prior to printing, preferably executed by the computer 21. The process of wetting the garment starts with element 57 by loading the image file from the computer's storage. The process progresses to element 58 to determine the edges of the image on the garment, which are also the edges of the area to be wetted. The process continues to element 59 to activate the X-axis 12, which moves the printing table 13. The process advances to element 60 to receive from the encoder the position data of the printing table 13. The process proceeds to element to determine which nozzles to open (element 61) or close (element 62) and sends the appropriate commands (elements 63 and 64) to the nozzle solenoids 35, preferably via the PLC 40. When the other edge of the image is reached (element 65) the process is stopped (element 66).

The printing system of the embodiments described above incorporates three processes, one after the other:

1. Loading and unloading garments.
2. Wetting at least a part of the area of the garment to be printed.
3. Printing an image on the mounted over at least a part of the wetted area.

In order to increase the throughput of the system, these processes can be performed in parallel, as seen in the above embodiments of the invention.

It will be appreciated that the invention is not limited to what has been described hereinabove merely by way of example. Rather, the invention is limited solely by the claims that follow.

It is expected that during the life of this patent many relevant liquid applicator devices and ink applicator devices and systems will be developed and the scope of the terms herein, particularly of the terms "spraying nozzles" and "inkjet nozzles", is intended to include all such new technologies a priori.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A printing system for printing on a surface comprising:

at least one printing apparatus comprising at least one ink applicator operative to print an image over at least a part of said surface; and at least one wetting apparatus comprising at least one liquid applicator operative with said ink applicator to apply a wetting composition over at least a portion of said part of said surface prior to printing, said wetting composition being adapted to interfere with the engagement of a liquid ink composition with at least one binding site of said surface, the wetting apparatus further comprising at least one retractable bath carrying a thinner liquid, said thinner liquid operative to prevent said wetting composition from drying within said liquid applicator, said retractable bath positioned beneath said liquid applicator and operative to be retracted on demand to expose said liquid applicator to apply said wetting composition onto said surface.

2. The printing system according to claim 1, further comprising at least one controller operative to control said at least one liquid applicator to apply said wetting composition onto selected parts of said surface.

3. The printing system according to claim 1, further comprising:

a rigid frame;

a linear motion X-axis mounted on said frame;

at least one table assembly, operative to bear a printable medium, movable on said linear X-axis;

a bridge mounted on said frame perpendicular to said linear X-axis, above said table assembly;

said at least one liquid applicator mounted on said bridge, said at least one liquid applicator operative to apply a wetting composition onto said printable medium, said wetting composition being capable of interfering with the engagement of a liquid ink composition with at least one binding site of the surface of said printable medium;

a linear motion Y-axis stage mounted on said frame perpendicular to said linear X-axis stages, above said printing table assembly; and said at least one ink applicator mounted on said linear Y-axis stage for linear motion perpendicular to said X-axis stage.

4. The printing system according to claim 1, further comprising:

a rigid frame;

a first linear motion X-axis stage mounted on said frame;

a second linear motion X-axis stage mounted on said frame parallel to said first axis stage, and arranged for operation independently of said first axis stage;

at least one table assembly, operative to bear a printable medium, movable on each said linear X-axis;

a bridge mounted on said frame perpendicular to said linear X-axis, above said table assemblies;

said at least one liquid applicator mounted on said bridge, over each of said X-axis, said at least one liquid applicator operative to apply a wetting composition onto said printable medium, said wetting composition being capable of interfering with the engagement of a liquid ink composition with at least one binding site of the surface of said printable medium;

a linear motion Y-axis stage mounted on said frame perpendicular to said linear X-axis stages, above each of said printing table assemblies; and said at least one ink applicator mounted on said linear Y-axis stage for linear motion perpendicular to said X-axis stage.

5. The printing system according to claim 1, and wherein said image is a photograph.

6. The printing system according to claim 1, wherein said surface comprises of at least one of fibrous material, porous material, material having a high surface tension with said liquid ink.

7. The printing system according to claim 1, wherein said wetting apparatus comprises a controllable wetting applicator for wetting selected locations of said surface prior to printing.

* * * * *